United States Patent [19]

Jones

[11] Patent Number: 4,691,672

[45] Date of Patent: Sep. 8, 1987

[54] CYBERNETIC ENGINE

[76] Inventor: Horace L. Jones, 9613 Woodstream Dr., Richmond, Va. 23233

[21] Appl. No.: 811,916

[22] Filed: Dec. 20, 1985

[51] Int. Cl.[4] ..... F01L 9/04

[52] U.S. Cl. ..... 123/90.11; 123/414

[58] Field of Search ..... 123/90.11, 414

[56] References Cited

U.S. PATENT DOCUMENTS

| | | | |
|---|---|---|---|
| 3,548,793 | 12/1970 | Richardson | 123/90.11 |
| 3,682,152 | 8/1972 | Müller-Berner | 123/140 MC |
| 3,757,755 | 9/1977 | Carner | 123/414 |
| 3,830,207 | 8/1974 | Joseph | 123/32 EA |
| 3,882,833 | 5/1975 | Longstaff et al. | 123/90.11 |
| 4,009,697 | 3/1977 | Chateau | 123/414 |
| 4,020,803 | 5/1977 | Thuren et al. | 123/32 VN |
| 4,312,494 | 1/1982 | Aoyama | 251/48 |

FOREIGN PATENT DOCUMENTS

| | | | |
|---|---|---|---|
| 195004 | 11/1983 | Japan | 123/90.11 |

*Primary Examiner*—Ira S. Lazarus

*Attorney, Agent, or Firm*—Henderson & Sturm

[57] ABSTRACT

An internal combustion engine designed to enhance energy conservation and environmental pollution control with reliability and performance through the use of state-of-the-art technology. The engine incorporates a unique timing disc that allows the engine to be designed with 70% fewer moving parts, reducing both friction and weight. This in turn results in increased engine longevity with reduced maintenance. The engine is designed to increase the delivered horsepower by 40%, with less fuel consumption. The fuel delivery system is designed to create a clean burn, thereby increasing fuel efficiency; pollution and minimizing the load on pollution control systems.

6 Claims, 6 Drawing Figures

CYBERNETIC ENGINE

TECHNICAL FIELD

This invention relates to internal combustion engines and more particularly to an internal combustion engine utilizing a unique timing disc coupled with a data processor.

BACKGROUND ART

The first development of successful internal combustion engines occurred in the eighteenth and nineteenth centuries. The four stroke engine has developed as the type used in modern automobiles since this design is most efficient at intaking the fuel-air mixture and exhausting the waste gases. A major disadvantage of the conventional four stroke engine is the large number of moving parts used to control the timed operation of the intake and exhaust valves. The large number of parts results in increased manufacturing and maintenance costs.

Those concerned with these and other problems recognize the need for an improved internal combustion engine.

DISCLOSURE OF THE INVENTION

The present invention provides an internal combustion engine designed to enhance energy conservation and environmental pollution control with reliability and performance through the use of state-of-the-art technology. The engine incorporates a unique timing disc that allows the engine to be designed with 70% fewer moving parts, reducing both friction and weight. This in turn results in increased engine longevity with reduced maintenance. The engine is designed to increase the delivered horsepower by 40%, with less fuel consumption. The fuel delivery system is designed to create a clean burn, thereby increasing fuel efficiency; pollution and minimizing the load on pollution control systems.

An object of the present invention is the provision of an improved internal combustion engine.

Another object is to provide an internal combustion engine utilizing a novel timing system that permits an engine design having substantially fewer moving parts.

A further object of the invention is the provision of an internal combustion engine that has an improved operating life.

Still another object is to provide an internal combustion engine that is inexpensive to manufacture and easy to maintain.

A still further object of the present invention is the provision of an internal combustion engine that allows for greatly improved fuel efficiency.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

The engine of the present invention is designed to have as few moving parts as possible. This reduces friction, weight, repair time, and increases efficiency. The engine used is a standard V-8 engine. The engine is stripped of intake manifold, carburetor, camshaft, push rods, tappets, intake valves, rocker arms, fuel linkage, and distributor. This leaves the crankshaft, pistons, and timing chain as the only moving parts in the block—fewer moving parts with no loss in raw horsepower or performance.

The engine heads have been modified to eliminate oil flow and circulation into the valve covers. The oil will only be used in the block of the engine. The heads are modified further to accommodate an exhaust valve only, and a direct cylinder injector, instead of an intake valve. This eliminates the use for valves, push rods, tappets, and a camshaft. The timing will be picked up from crankshaft rotations to a timing disk that will synchronize all timings of injectors and exhaust relief ports in proper sequence.

The cybernetic engine does not use a distributor. The firing of each spark plug is to be generated by signals from the processor to the power supply. The timing to fire for each cylinder is calculated by a stroke counter incorporated in the electronics of the computer. This eliminates the use of a distributor. The power supplied to each plug is advanced in proportion to the revolutions per minute under the control of the processor, insuring a cleaner burn and positive ignition.

Fuel vapor is injected into each cylinder by an electronic valve that is opened and closed for the proper duration of time. The proper sequence in time being controlled by the processor. The fuel, before being distributed through a distribution block to each cylinder, is transformed into a vapor and injected by a signal generated in the processor to open the injector of the cylinder being on the first stroke. Air is mixed with the fuel vapor through the same injector. The air is forced into the injector by an air pump. This eliminates the use of an intake manifold, carburetor, and associated linkage.

The exhaust will be routed directly from the electronically actuated exhaust valve port into the exhaust system. The increase of revolutions per minute is accomplished by the accelerator or exciter. This will leave the injector valve open for a longer period of time as the exciter is depressed, thus increasing the revolutions per minute of the engine. The design of this engine will increase the horsepower and longevity of the engine. Fuel will be used to maximum efficiency—greatly increasing the estimated miles-per-gallon.

HEAD DESIGN

Figure 1:
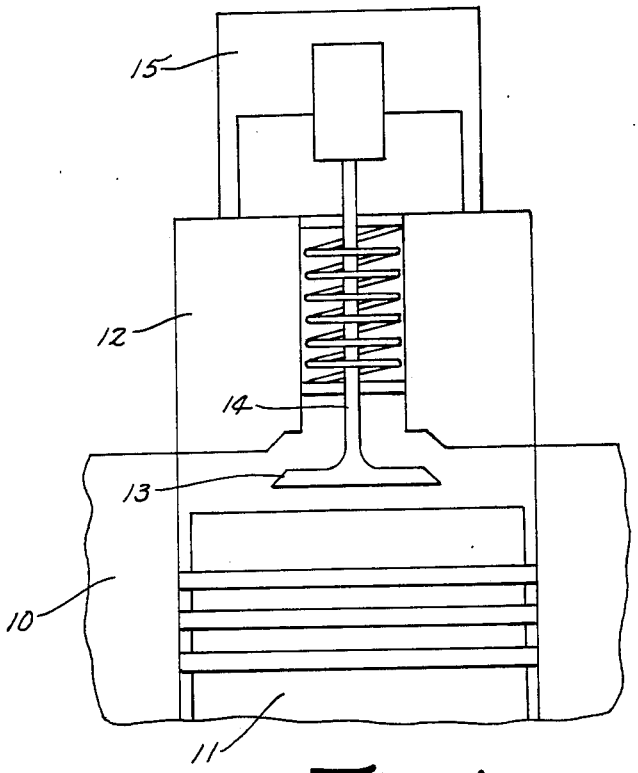
FIG. 1 is a schematic illustrating the solenoid operated exhaust valve used on the internal combustion engine of the present invention.
Figure 2:
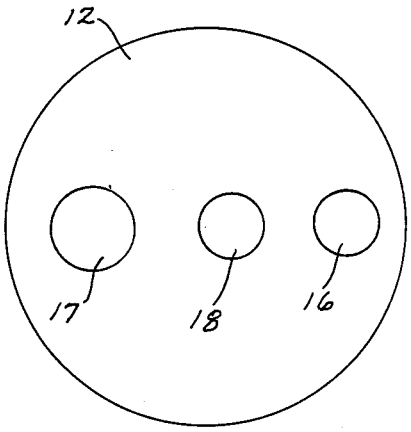
FIG. 2 is a schematic of the cylinder head.

The head either being "L" type or hemispherical, has been altered to accommodate the redesigned injection and exhaust system as illustrated in FIGS. 1 and 2. The elimination of the camshaft, by the timing disc, alters the intake and exhaust valve for each cylinder. Referring now to FIG. 1, it can be seen that the block (10) carries a piston (11) and the head (12) carries only one valve (13) for each cylinder—the exhaust valve (13). This valve (13) is of the same standard valve as a conventional engine, and in the same location. The stem (14) of the valve (13) has been shortened and is actuated electronically by a solenoid (15). This type of actuator for the expelling exhaust vapor eliminates the use and function of rocker arms and push-rods.

As shown in FIG. 2, the head (12) is designed without the ports for the push-rods and taps for mounting the rocker arms. The fuel intake port (16) is used instead of an intake valve. This port is machine-threaded to be one inch in diameter. The location of the port is 180 degrees out or opposite the exhaust valve port (17). The spark plug opening (18) is centrally located and the spark plug is at an angle of 30 degrees towards the intake port (16).

The injector (not shown) is mounted in the intake port (16) and is actuated electronically. The spark plug is one of conventional design. The location of the spark plug is in the center of the cylinder head in between the exhaust valve port (17) and injector port (16).

The oil ports are eliminated. There are no rocker arms that need to be lubricated. The upper portion of the exhaust valve stem (14), above the retainer, is lubricated periodically with a high-grade lubricant containing moly. This moly-base lubricant retains its viscosity under high degrees of heat. Oil ports and return ports are eliminated in the design of the head. The cooling system's water flow through the head (12) can be expanded due to the elimination of the rocker arms and valves. The design of the heads (12) incorporates a more efficient cooling system as a result. The heads (12) are pre-tapped to accommodate the mounting of solenoids (15) for the exhaust valves (13) and associated hardware.

ENGINE BLOCK AND OIL PUMP MODIFICATIONS

The engine block remains the same as any standard engine in reference to displacement, stroke, and bearings. The position and placement of the crankshaft and pistons are the same as in a conventional engine.

(1) Oil Pump Modification

The oil pump is modified to eliminate the pumping of oil into the valve pushrods, rocker arms, and valve covers. Lubrication is not needed in these areas. Eliminated are the camshaft, tappets, pushrods, valve lifters, and rocker arms. The moving parts of the engine will consist of crankshaft, pistons, and connecting rods. Lubrication of these areas stays the same as in a standard engine. Oil is distributed to the mains, inserts, connecting rods, pistons, and cylinder walls as in a conventional engine, since timing is being picked up via the crankshaft. Lubrication is supplied to a timing chain on the front spline of the crankshaft. This chain is linked to the main timing disc. The amount of oil used is reduced due to the elimination of the need to lubricate the upper portion of the engine.

(2) Block Casting Modification (Cam, tappets, and pushrods).

The elimination of the camshaft, tappets, and valve pushrods results in a redesign in the casting of the block. The new design reduces the block's weight by 15%. This redesign also enlarges the cavity of the upper opening of the engine. Where on a standard engine the upper portion houses the camshaft, intake manifold, and carburetor, this location now carries the fuel expansion chambers and distribution block. Taps and casting for the camshaft and tappets are eliminated. new taps are drilled to accommodate the mounting of a fuel chamber, fuel pump, and associated hardware.

(3) Block Casting Modification (Cooling veins).

The elimination of valve tappets and pushrods enables the enlarging of the diameter of the cooling veins running through specified areas of the block. This insures a proper running temperature for the engine. Water veins running to the heads are dedesigned to compliment the design of the heads.

EXHAUST RELIEF SYSTEM

The exhaust system is designed to eliminate the use of the camshaft, tappets, pushrods, and rocker arms. The timing of the exhaust valve (13) is under the control of the processor. Referring again to FIG. 1, the exhaust valve (13) is opened on the third stroke of the piston (11) by means of a solenoid (15). This solenoid (15) is energized by a signal from the processor. The processor senses that the piston (11) is returning from combustion (3rd stroke) and generates the signal OPEX (Open Exhaust Valve). The exhaust valve (13) stays open until the piston (11) is in the apex position of the combustion chamber. Immediately upon the piston (11) reaching the apex position, the exhaust valve (13) is closed by a signal generated by the processor CLEX (Close Exhaust Valve).

The exhaust valve (13) works in the same way as an exhaust valve in a standard engine. The same valves and reliefs are used. The valve stem (14) length is shorter than that of a standard valve. The valve (13) is energized by a solenoid (15). This solenoid (15) is mounted on the head (12) over the extended end of the valve stem (14). Upon correct timing, the solenoid (15) is energized by a signal from the processor and the valve (13) is opened. The solenoid (15) is de-energized and the valve (13) closed upon the piston (11) reaching the correct position.

The exhaust vapors escape into the exhaust manifold and into the exhaust system as in a standard engine. The travel on the solenoid (15) is fixed, there is no adjustment for travel. the use of vapor instead of raw gas in the combustion chamber, results in the engine burning cleaner, with less emission than in a standard combustion engine. The need for emission controls is minimized.

TIMING DISC

Figure 3:
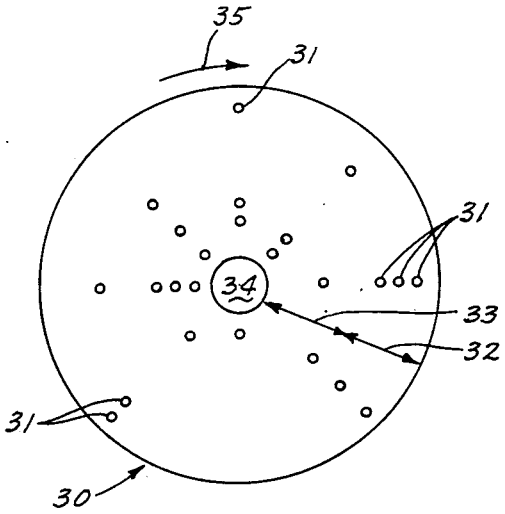
FIG. 3 is a schematic showing the timing disc having firing and return apertures for each of eight cylinders.

FIG. 3 illustrates one embodiment of the timing disc (30). In this embodiment, the timing disc (30) is 8 and one-half inches in diameter, and one-half inch thick. The timing disc (30) is made of a phenolic material or other suitable materials having adequate strength and a low coefficient of expansion. The apertures (31) are $\frac{1}{8}$ inch in diameter. These apertures (31) are positioned on the timing disc (30) giving reference to the positions of each piston (11). The engine is a four stroke engine. The timing disc apertures (31) are positioned to read the firing order of each cylinder. Four apertures (31) are used to accommodate eight cylinders through a binary count. The firing order apertures (31) are located on the outer-side (32) of the timing disc (30). The number one aperture (31) is one-half inch from the outer edge of the disc (30). Each aperture (31) is one-fourth inch distant from the next aperture (31). The four apertures (31) will extend $1\frac{1}{4}$ inches into the center of the timing disc (30).

Extending further inward on the innerside (33) of the timing disc (30) is the return apertures (31). There are four return apertures (31), they continue in-line from the first four firing apertures (31) and are equi-distant apart and spaced every forty-five degrees (45 degrees). This allows for a one-half inch distance before reaching the spline shaft (34).

As most clearly shown in FIG. 3, the apertures (31) are one-half inch from the outer edge and extend inward to within one-half inch from the inner edge of the timing disc. The apertures (31) are in a binary configuration.

The following are examples of how the apertures (31) count the strokes. In these examples, the firing order is set as 1, 8, 4, 3, 6, 5, 7, 2. The rotation of the timing disc (30) is clockwise, as indicated by the directional arrow (35). When the aperture (31) corresponding to the number one (1) cylinder and aligns with the light source, the photosensor is triggered; a signal is generated and sent to the processor. This signal indicates that the number one (1) cylinder is in the upper-most position.

The binary configurations illustrated in FIG. 3 are as follows:

| EXAMPLE 1 | EXAMPLE 2 | EXAMPLE 3 | EXAMPLE 4 |
|---|---|---|---|
| 1 = 0 | | | 1 = 0<br>2 = 0 |
| | | 4 = 0 | |
| 5 | 8 = 0 | | |
| No. 1<br>Cylinder | No. 8<br>Cylinder | No. 4<br>Cylinder | No.3<br>Cylinder |

As the timing disc (30) rotates, the first aperture aligns with the light source. (See example 1). Example 2 shows the fourth aperture aligned with the light source, causing the photosensor to generate a signal indicating number eight (8) cylinder; this signal is sent to the processor. Example 3 shows the next cylinder, in the firing order, to arrive at the upper-most position to be cylinder number four (4). Aperture number three aligns with the light source triggering the photosensor, sending a signal to the processor for cylinder number four (4). In Example 4, the next cylinder in the firing order is cylinder number three (3). When the first and second apertures align with the light source and triggers the photosensor, the signal for cylinder number three (3) is sent to the processor.

The following examples further explain the binary concepts used in counting out cylinder position and order of the firing apertures located on the outer side (32) of the timing disc (30). The plus sign (+) represents an aperture or apertures aligned with the light source. The minus sign (−) indicates no aperture is present on the timing disc (30) at the indicated location.

| FIRING ORDER 1, 8, 4, 3, 6, 5, 7, 2 | | | |
|---|---|---|---|
| CYLINDER | CYLINDER | CYLINDER | CYLINDER |
| NO. 1 | NO. 8 | NO. 4 | NO. 3 |
| 1 = +<br>2 = −<br>4 = −<br>8 = − | 1 = −<br>2 = −<br>4 = −<br>8 − + | 1 = −<br>2 = −<br>4 = +<br>8 = − | 1 = +<br>2 = +<br>4 = −<br>8 = − |
| 1 | 8 | 4 | 3 |
| NO. 6 | NO. 5 | NO. 7 | NO. 2 |
| 1 = −<br>2 = +<br>4 = + | 1 = +<br>2 = −<br>4 = + | 1 = +<br>2 = +<br>4 = + | 1 = −<br>2 = +<br>4 = − |

-continued

| FIRING ORDER 1, 8, 4, 3, 6, 5, 7, 2 | | | |
|---|---|---|---|
| CYLINDER | CYLINDER | CYLINDER | CYLINDER |
| 8 = − | 8 = − | 8 = − | 8 = − |
| 6 | 5 | 7 | 2 |

The above examples show all the apertures on the outer side (32) of the timing disc (30) pertaining to the cylinder numbers. An additional set of return apertures continuing from the first set of four, indicate the positions of the pistons (11). Location of each piston (11) in each cylinder along with the count order for the next stroke can be determined. These apertures are also used along with the firing apertures to generate signals for the injectors and the exhaust valves. These are called return apertures and are set 180 degrees outward from the firing apertures. These apertures are picked up by a separate photosensor that sends a signal to the processor to indicate the return of a particular piston. In this manner, two strokes are counted. The following is an example of cylinder number one as it aligns with the light source and triggers the photosensor. The minus sign (−) indicates the apertures are not present on the timing disc (30).

1 = + Firing Apertures For Cylinder Number One
2 = −
4 = −
8 − −
8 = −
4 = + Return Aperture For Cylinder Number Six
2 = + Return Aperture For Cylinder Number Six
1 = 0
1 = + Return Aperture For Cylinder Number One
2 = −
4 − −
8 = −
8 = −
4 − + Firing Aperture For Cylinder Number Six
2 = + Firing Aperture For Cylinder Number Six
1 = −

In FIG. 3 and the previous example, the firing aperture for cylinder number one is in a twelve o'clock position. Each of the eight cylinders has an aperture or set of apertures placed at an angle of 45 degrees in relation to the next aperture or set of apertures on the timing disc (30). Since the timing gear is in a one-to-one ratio with the crankshaft gear, each 180 degrees turn of the timing disc (30) brings that respective piston (11) half a full rotation. As the crankshaft turns one-half of a full rotation, the return apertures for that piston (11) will align with the light source and trigger the return photosensor. This signal is sent to the processor to indicate the return of the second stroke. The two apertures shown on the opposite outward side of the timing disc are 180 degrees out from firing aperture for cylinder number one and are used for cylinder number six.

TIMING DISC MOUNTING

Figure 4:
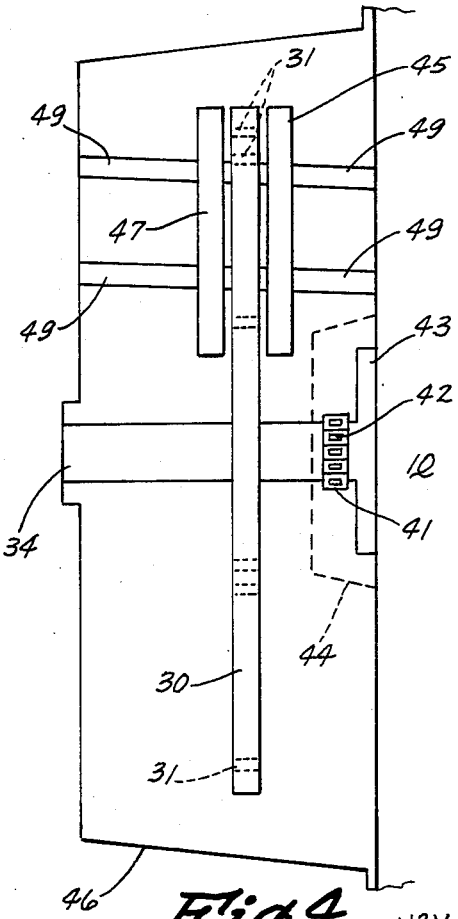
FIG. 4 is a schematic showing the mounting of the timing disc on the engine block.

Referring now to FIG. 4, the timing disc (30) is shown located on the front of the engine mounted to the front of the right head and block (10). The disc (30) is driven by a chain (41) running from the front spline of the crankshaft to the spline gear (42) located on the spindle (34) carrying the timing disc (30). The spline gear (42) on the timing spindle (34) is spaced one-fourth inch from the spindle mounting assembly (43). The timing chain (41) and spline gears (42) are covered by a shroud (44). The spindle (34) projecting through the shroud (44) carries an oil seal (not shown). The gear and chain assembly will be lubricated with oil from the block. A cylindrical washer on the inside of the crankshaft spline gear (not shown) will circulate oil onto the chain (41). The chain (41) will carry the oil to the timing spline gear (42). The diameter and number of teeth of the crankshaft spline gear and timing spline gear (42) are the same, giving a one-to-one ratio.

The timing disc (30) is located one and one-half inches spaced from the face of the right head and block (10), on the timing spline (42). This allows room for the timing spline mounting (43), spline gear (42), and oil shroud (44). This one and one-half inch spacing is also the proper distance to mount the light source (45) on mounts (49) and allows for its ease in replacement. Covering the entire assembly is the timing disc shroud (46). The photosensor (47) is mounted by mounts (49) to the shroud (46). These components are precision machined, insuring exact alignment. The photosensor (47) is aligned directly in front of the timing disc (30), facing the light source (45). Both the light source (45) and the photosensor (47) are positioned one-thirty second of an inch from the face of the timing disc (30). There is an access plate (not shown) on the top of the timing shroud (40) for ease of inspection and replacement. The photosensor (47) and light source (45) are securely mounted with no further adjustments needed. The timing assembly is completely enclosed and contamination free.

PHOTOCELL THRESHOLD CIRCUIT

Figure 6:
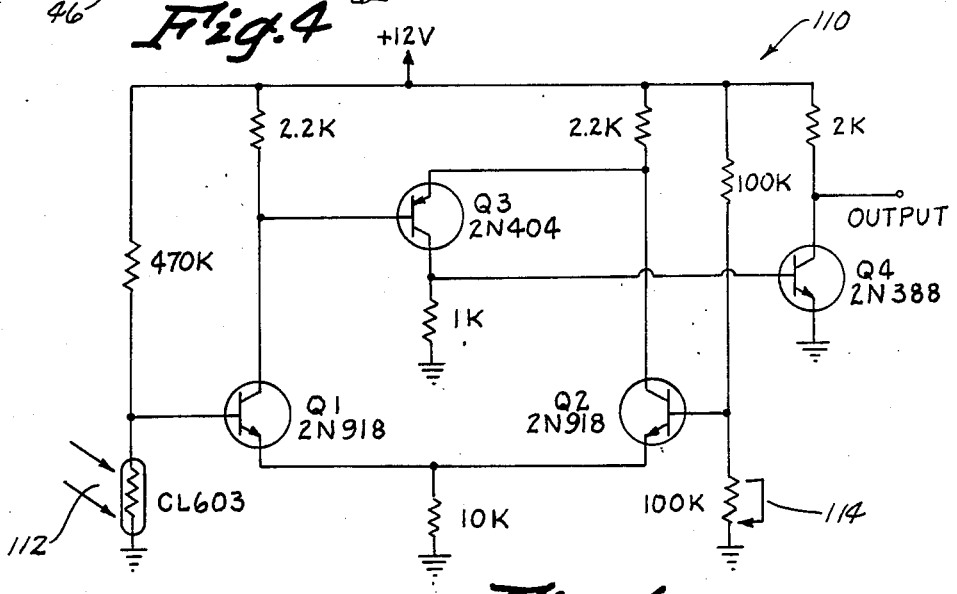
FIG. 6 is an electrical schematic illustrating a light activated switching circuit using a resistive photocell that has an outport compatible with standard logic.

Referring now to FIG. 6, the variable threshold photocell amplifier (110) draws negligible current in the quiescent state. When the incident light (112) reaches the predetermined threshold level, the circuit switches rapidly from 12 volt to zero output. These output voltages are standard logic levels. The low current drain allows battery operation of the circuit.

Transistors Q1 and Q2 form a differential amplifier with the reference voltage at the base of Q2 set by the voltage divider adjustment (114). As Q2 is normally on and Q1 is off, the base emitter junction of Q2 is backbiased. When the light input (112) causes the photocell resistance to increase, Q1 turns on and Q2 turns off. Thus, Q3 is forward-biased and current flows into the base of Q4 to saturate that stage.

The collector of Q4 switches rapidly from 12 volts to zero, giving an output compatible with standard logic.

Note that all transistors, except Q2 are off in the quiescent state, thereby lowering the power drain.

TIMING—FOUR STROKE

The time begins with the timing disc (30). When the timing disc (30) and the number one cylinder aperture are in front of the light source (45) this triggers the number one cylinder photosensor (47). This places the piston (11) in the number one cylinder in the up position (home position), ready for its first stroke. The photosensor (47) sends a signal to the processor. This signal, 1CY1ST (Number one cylinder/first stroke), is placed into a register in the processor. The processor uses this information to accomplish several functions. First, it increments a binary counter that will give a true revolutions per minute count. Secondly, it generates a signal, OPINJ1 (Open injector number one). This signal opens the number one cylinder injector, allowing fuel vapor and an air mixture into the firing chamber, at the same time as the piston (11) is travelling downward on the first stroke. This signal OPINJ1 is A.N.D. with the signal CLINJ1 (Close injector number one). The signal CLINJ1 is generated from the accelerator. The accelerator as it is depressed, operates a potentiometer. When the signal OPINJ1 is removed from the gate, it will close the injector of cylinder number one.

Backtracking to show the establishing of a standard by which the signal CLINJ1 is being generated in reference to the accelerator, the electronics are designed to calculate the time the injector will remain open, generating a specific revolutions per minute reading.

The program is strapped for a maximum revolutions per minute reading, (the model will use 5,000 revolutions per minute as a maximum reading). The accelerator is used to establish an on/off division of the injector time. The accelerator being a potentiometer will establish a divisonable parameter with respect to injector on, injector off, length of stroke, and revolutions per minute. The computer generates its own internal timing. For example, from the moment the injector is opened, the piston (11) is travelling downward in the cylinder. When the piston (11) reaches the bottom of the cylinder, it completes its first stroke. The timing disc (30) will be 180 degrees out-of-phase and the return aperture is aligned with the light source (45), triggering the return photocell (47). This signal is 1CY2ST (Number one Cylinder Second Stroke). There are other signals generated by this return signal to be explained in detail hereinafter. A ratio of stroke length to duration of time in revolutions per minute is thus established.

If the accelerator, a potentiometer, is depressed to fifty percent of its maximum, it will allow for only 2,500 revolutions per minute. The processor will allow the injector to remain open for a specified duration of time, allowing a predetermined amount of fuel into the combustion chamber to reach the allowed for revolutions per minute before closing the injector with the signal (CLINJ1). This signal being held low at the AND gate will terminate the signal OPINJ1. At the same time that the injector is opened to allow fuel into the chamber, a second valve is opened. This valve is part of the fuel injector and is a mixing valve. This valve allows air to be mixed with the fuel as it enters the chamber. The signal 1CY1ST generates the signal OPAV1 (Open Air Valve No. 1), which is the first injector. This air valve is opened for the same duration of time as the fuel injector. The amount of air or fuel mixture is preset during tune-up. This is accomplished by manually adjusting the fuel mixture until an optimum combustion ratio is reached. The signal to close the air valve is CLAV1 (Close Air Valve No. 1). The signal used to close the injector is CLINJ1. These are the same signals. Their nomenclature is changed for logic purposes.

The timing disc (30) is now 180 degrees out-of-phase in relation to the start of the number one aperture. This increments the stroke counter or flip-flops to show the second stroke in progress. this signal is generated by a count of two, (via the return of the number one aperture), to the input AND gate. The second input of this AND gate is generated by the timing disc (30) upon the number one aperture becoming aligned with the light source (45) for the second time. This triggers the photosensor (47) and generates the signal 1CY3SR (No. 1 Cylinder 3rd stroke). The signal generated earlier by the return aperture and the second flip-flop being set, is 1CY2NDST (No. 1 Cylinder 2nd Stroke). The piston (11) is now in the home position. This second stroke has compressed the fuel and air mixture. Now both signals 1CY3ST with 1CY2NDST allows for passage through the AND gate and generates the signal F1CY (Fire No. 1 Cylinder). The signal F1CY will energize the current flow to the sparkplug and fire the number one cylinder, this creates the third stroke.

During the piston travel of the second stroke, there were no signals generated to open the injector or the exhaust valve. As the piston (11) reaches the bottom of the cylidner, the timing disc (30) is at the number one return aperture for the second time. The stroke counter is incremented, also a signal OPEX1CY (Open Exhaust Valve No. 1 Cylinder), is generated. This signal is sent by the processor to the exhaust valve solenoid (15), energizing and opening the exhaust valve (13). This signal remains high until the number one aperture is aligned with the light source (45) triggering the number one cylinder photosensor (47), cancelling the signal OPEX1CY.

The timing is skewed so that the closing of the exhaust valve (13) occurs prior to the injector being opened. The binary counter is reset by this signal and the cycle is restarted. Each cylinder in turn goes through the same timing sequence. This completes the sequence of events to accomplish the four strokes.

FUEL CHAMBER

Figure 5:
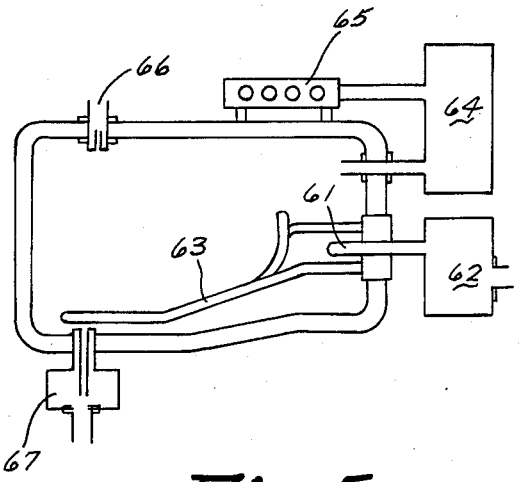
FIG. 5 is a schematic illustrating the fuel chamber used on the engine.

Referring now to FIG. 5, the fuel chamber (60) is designed to deliver gasoline in a vaporous state to the injectors (61) of each combustion chamber. Non-leaded gasoline is brought from the fuel tank by means of an electrical fuel pump (62). The fuel pump (62) is designed to spray the gasoline into the fuel chamber (60) under high pressure. The amount of fuel forced into the fuel chamber (60) is regulated to maintain a specific pressure of vaporous gasoline in the chamber (60). The fuel chamber (60) is cylindrical in design and manufactured to withstand pressures of upwards to 4,000 p.s.i. The operational range of the fuel chamber (60) is between 2,500 and 3,000 p.s.i.

The interior of the chamber (60) contains a heating element (63). This element is thermostatically controlled and is programmed to reach and maintain the proper temperature of vaporous gasoline, dependent upon the octane rated gasoline used. Because the ignition temperature of vaporous gasoline is higher, a safe operating range exists for vapor boil-off to ignition. Gasoline is sprayed across the heating element (63) becoming vaporous. The chamber (60) upon reaching the desired pressure of between 2,500 to 3,000 p.s.i. causes the fuel pump (62) to cut off. As the pressure drops, the fuel pump (62) is activated, remaining on until the desired pressure is once again reached. The exit port of the fuel chamber (60) is a pressure control valve (64). This control valve (64) can be regulated to increase pressure or decrease pressure depending on the demand of the fuel required for a higher or a lower revolutions per minute setting. Vapor leaving the pressure control valve (64) enters a distribution block (65) to be distributed to each combustion chamber injector. The lines to each injector are high pressure insulated lines. The injectors are processor controlled. Each injector is opened and closed in timing by a central processor. The length of time the injectors are opened is determined by the processor. This allows for higher revolutions per minutes settings, as the accelerator is depressed. The accelerator is controlling the fuel by means of the processor.

The fuel chamber (60) is designed with the front of the chamber floor gradually sloping downwards as shown in FIG. 5. The lower depth acts as a reservoir for recondensed fuel which occurs during periods that the engine is not in use. The front chamber floor is also used as a water trap. The heating element (63) is designed with an extension element that closely follows the contour of the chamber floor to its lowest depth. This extension element helps to vaporize any reconstituted fuel not utilized. The heating element (63) is regulated by the power supply (not shown) to maintain a specific temperature that ensures vaporization of the fuel. Located in the housing of the emergency relief valve (66) is a pressure sensor and heat sensor. The pressure and heat sensors are both monitored by the processor. Once the pressure in the fuel chamber (60) matches the preprogrammed pressure setting programmed in the processor, the heating element (63) automatically shuts off. The heating element (63) remains off until the pressure drops down to a predetermined level, at which point the heating element (63) is activated again.

Located in the fuel chamber floor is water purge sensor (67). This sensor (67) detects the presence of water that has separated from the fuel during condensation. The sensor (67) activates in the presence of water, generating a signal that is picked up by the processor. The processor generates a signal PWV (Purge Water Valve). This signal opens the water purge valve, voiding the fuel chamber (60) of the condensed water. The time duration of the water purge valve is preset for a short opening time. The valve will open for these short durations of time repeatedly until the fuel chamber (60) is completely void of water. The fuel chamber meets all safety requirements.

AIR PUMP

The air input to the combustion chamber is accomplished by means of an electrical air pump. The pump will maintain a specifically regulated pressure. The pump channels in outside air through a filtering system. The filtered air is forwarded to a distribution block. This block is designed similar to the fuel distributing block to distribute air to each injector. The cylinder injector has two exit port valves, one for the fuel vapor and the other for air. The air and fuel vapor are injected simultaneously.

The signal generated by the processor to open the number one injector for the number one cylinder, for both fuel vapor and air is OPINJ#1 (Open Injector No. 1). The signal used to accomplish this function is OPAV#1 (Open Air Valve No. 1). This function is for signal tracing purposes. The signal used to close the air injector is the same signal used to close the fuel injector CLINJ#1 (Close Injector No. 1). Again, for purposes of signal tracing, this signal is changed to CLAV#1 (Close Air Valve No. 1). The same signals are used to turn on and turn off both the fuel and air valves of the number one injector. The "on" time duration for both the air and fuel are identical. To regulate for proper burning, the mixture of air to fuel, a manual adjustment is made during turn-ups. The air port aperture diameter is adjustable to obtain the ideal mixture of air to fuel vapor for maximum performance. The air pump is located and mounted to the rear of the engine, for ease of maintenance.

PROCESSOR

The processor is a universal 8080 processor chip (National Semiconductor) with the associated electronics for registers and counters. the memory is an 8K dynamic RAM. The memory is expandable to accommodate for future use of additional features. A sister 8080 processor chip is used as a controller to run the IO/OP devices. The processor collects information from the various sending sensor units of the engine. This information is placed into the proper registers to be exercised by software instructions. The software instructions are permanently installed in the electronics. The instructions are a collection of PROM's (Programmable Read Only Memory). The initialization of the computer is boot-strapped, upon ignition turn on. The computer immediately comes under software control.

Information received from the sensors is utilized to generate commands which are relayed to the controller 8080 processor and distributed to the appropriate location for task performance.

The system is designed with both a plug port and a mode switch. The mode switch is in the diagnostic position and a pre-programmed diagnostic device is attached to the port. The memory can be checked for defective core and force signals that will exercise the electronics of the system. A readout of the failing component(s) is made in this manner. This diagnostic tool can easily be incorporated as an option in the existing system. The logic level used by the system is a six volt on the fall. The voltage levels are generated from a filtered power supply for low level and high level logic.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A timing mechanism adapted for use in conjunction with a four stroke internal combustion engine including a plurality of pistons disposed to reciprocate within cylinders and attached to a crankshaft in a timed sequence, each of said cylinders including a fuel-air intake and an exhaust valve; said timing mechanism comprising:

a timing disc rotatably attached to said engine and operably attached to and rotated by said crankshaft, said timing disc including:

a number of sets of firing order openings formed therethrough, each of said sets of firing order openings being spaced radially outward from the axis of rotation of said timing disc; and a number of sets of return openings formed through said timing disc 180° outward from a corresponding set of firing order openings;

a light source attached to said engine and disposed in closely spaced relationship to one side of said timing disc such that the light source emits light through said openings each time the openings are rotated into alignment with said light source;

a photosensor attached to said engine and disposed in closely spaced relationship to the other side of said timing disc opposite said light source such that light emitted through said openings strikes said photosensor; and means for electrically coupling said photosensor to selectively operate said fuel-air intake and said exhaust valve of each of said cylinders in a timed sequence.

2. The timing mechanism of claim 1 wherein the alignment of said radially spaced set of firing order openings with said light source corresponds to a known position of one of said pistons within the cylinder.

3. The timing mechanism of claim 2 further including a plurality of radially spaced set of firing order openings corresponding to each of said pistons, each of said set of firing order openings being angularly spaced from the next adjacent opening by an amount equal to 360 degrees divided by the total number of pistons.

4. The timing mechanism of claim 3 further including a plurality of radially spaced photosensors disposed in aligned position with respect to each of said sets of firing order openings as said timing disc rotates.

5. The timing mechanism of claim 1 wherein said each of said exhaust valves is a solenoid valve electronically coupled to said photosensor.

6. The timing mechanism of claim 1 wherein said sets of firing order openings are positioned toward the outer edge of said timing disc and said sets of return openings are positioned toward the innerside of said timing disc.

* * * * *